United States Patent [19]

Koland

[11] 4,397,058

[45] Aug. 9, 1983

[54] FURNITURE GUARD AND BEARING PAD FOR VACUUM CLEANER NOZZLE

[75] Inventor: David G. Koland, Sandstone Township, Pine County, Minn.

[73] Assignee: Whirlpool Corporation, Benton Harbor, Mich.

[21] Appl. No.: 310,375

[22] Filed: Oct. 13, 1981

[51] Int. Cl.[3] ..... A47L 9/00

[52] U.S. Cl. ..... 15/325; 15/392

[58] Field of Search ..... 15/325, 377, 392

[56] References Cited

U.S. PATENT DOCUMENTS

| | | | |
|---|---|---|---|
| 1,695,246 | 12/1928 | Gammeter | 15/325 |
| 2,359,194 | 9/1944 | Becker | 15/325 X |
| 2,620,506 | 12/1952 | Weiland | 15/325 X |
| 2,857,613 | 10/1958 | Meyerhoefer | 15/328 |
| 3,802,026 | 4/1974 | Crener | 15/392 X |
| 3,916,476 | 11/1975 | Johnson et al. | 15/325 X |

*Primary Examiner*—Chris K. Moore

*Attorney, Agent, or Firm*—Wood, Dalton, Phillips, Mason & Rowe

[57] ABSTRACT

A furniture guard and bearing pad structure for use with a vacuum cleaner nozzle. The nozzle defines a laterally enlarged front portion. The furniture guard and bearing pad structure is defined by a bumper element which is preformed to closely fit the irregular shape of the nozzle. The bumper is provided with a plurality of T-section connectors retained in outwardly opening slots in the peripheral wall of the nozzle. Bearing pads are formed integrally with the bumper and, in the illustrated embodiment, include projecting portions received in recesses in the nozzle for accurately locating the bearing pads. In the illustrated embodiment, the sidewalls of the nozzle are provided with openings receiving portions of the vacuum cleaner projecting from the base of the nozzle. A rotatable beater brush is rotatably carried by the projecting portions. In the illustrated embodiment, the projecting portions terminate outwardly flush with the sidewalls of the nozzle cover portion and the bumper overlies the projecting portion of the base across the openings of the cover portion.

18 Claims, 10 Drawing Figures

FIG. 1
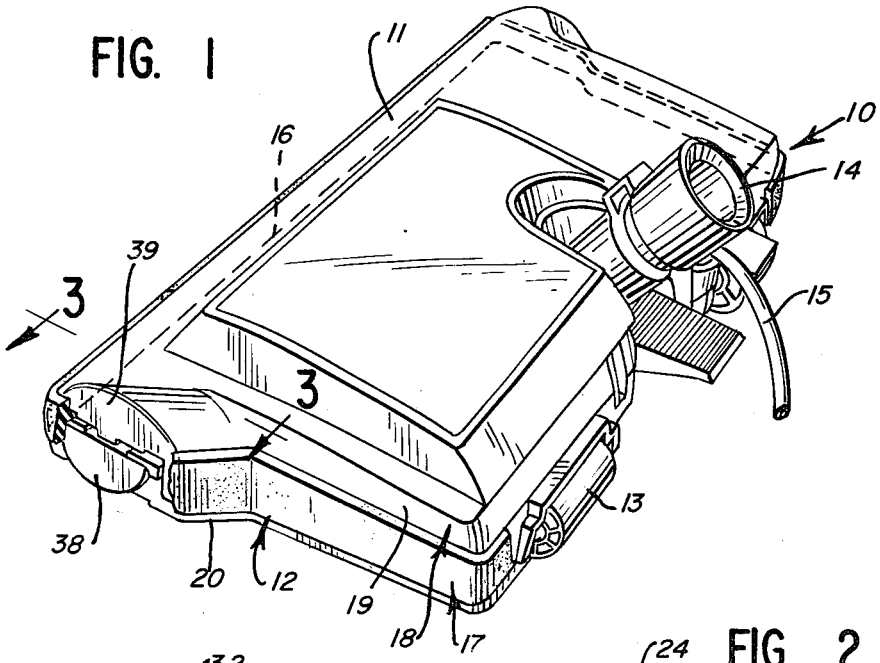
FIG. 2
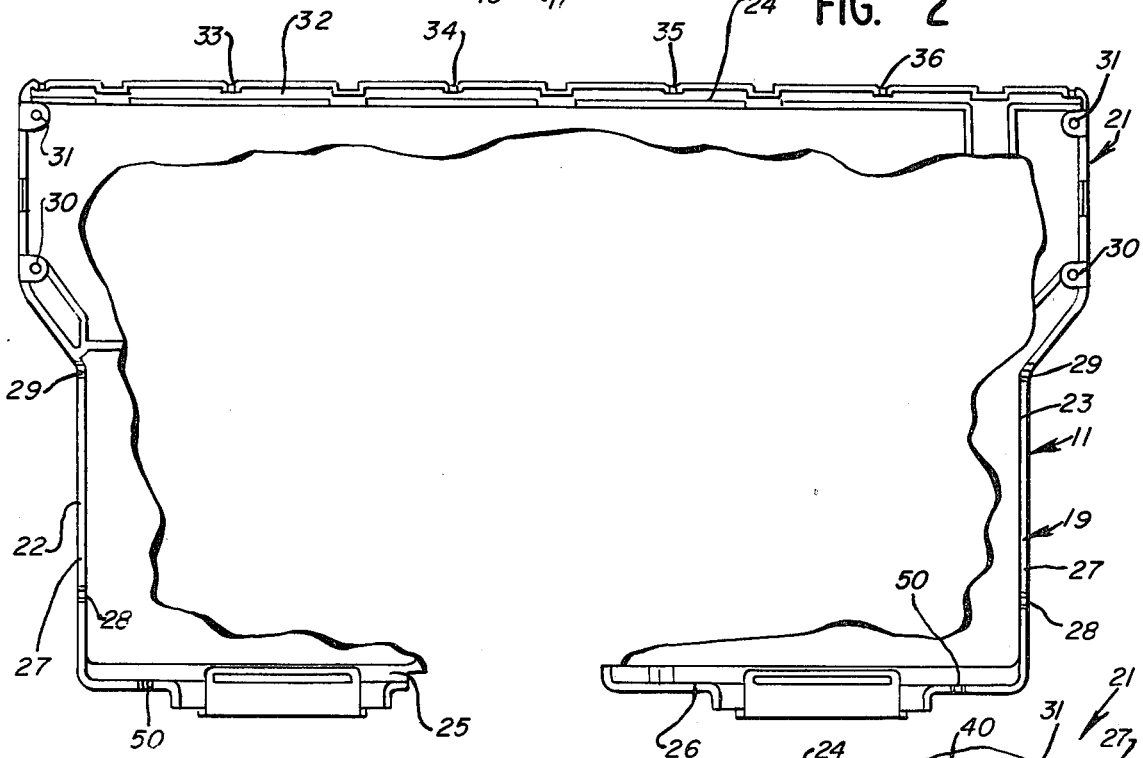
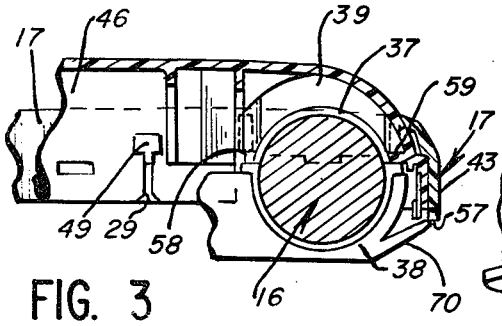
FIG. 3
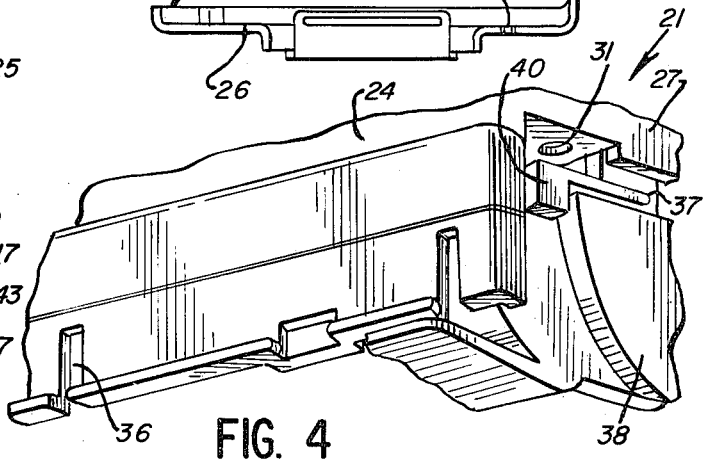
FIG. 4

FIG. 5
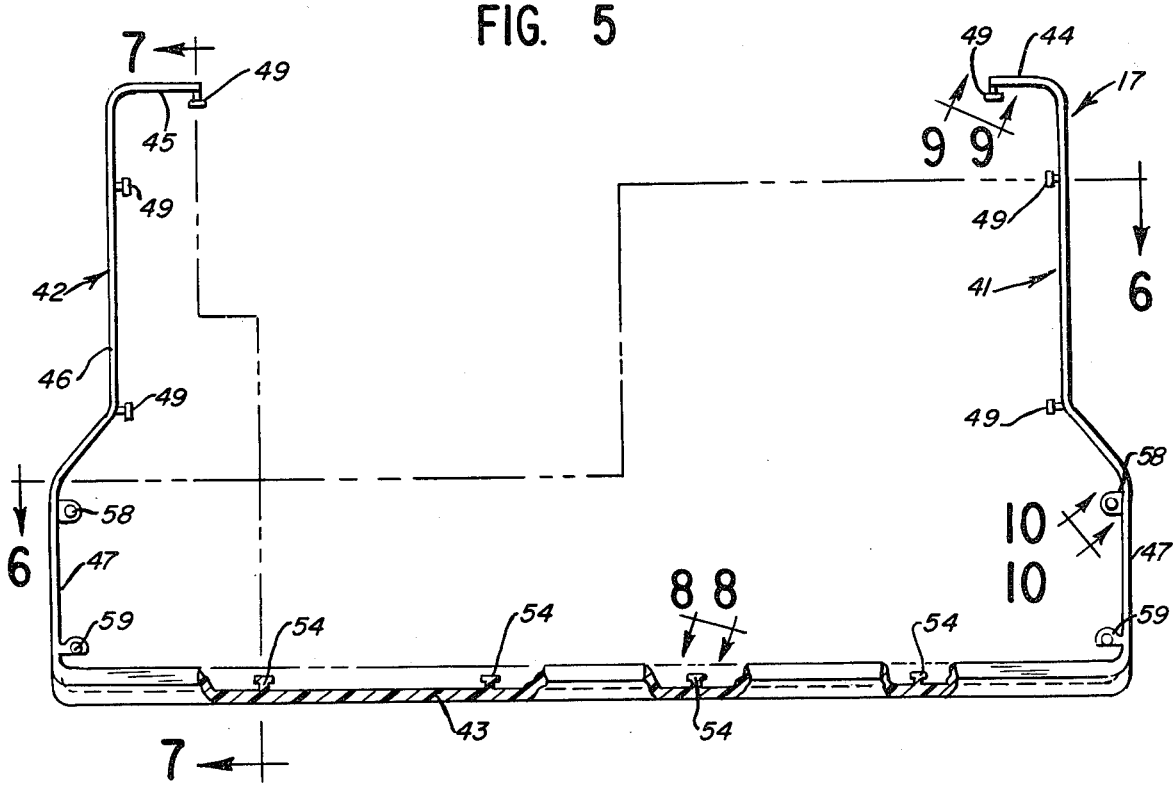
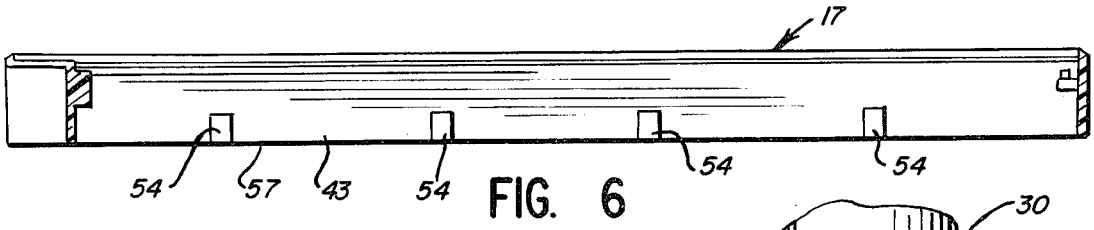
FIG. 6
FIG. 7
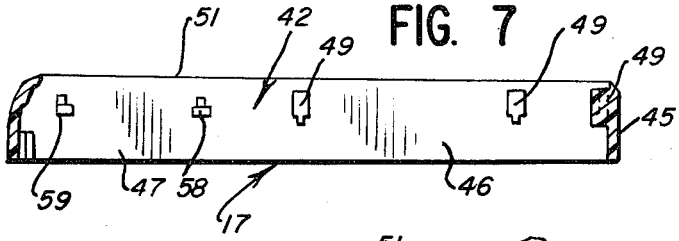
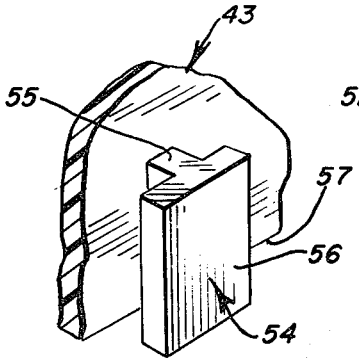
FIG. 8
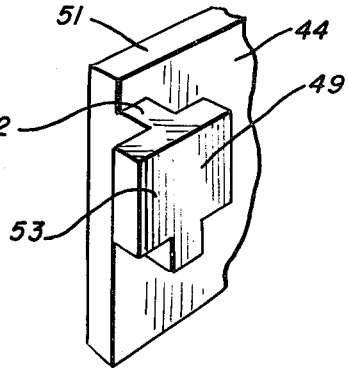
FIG. 9
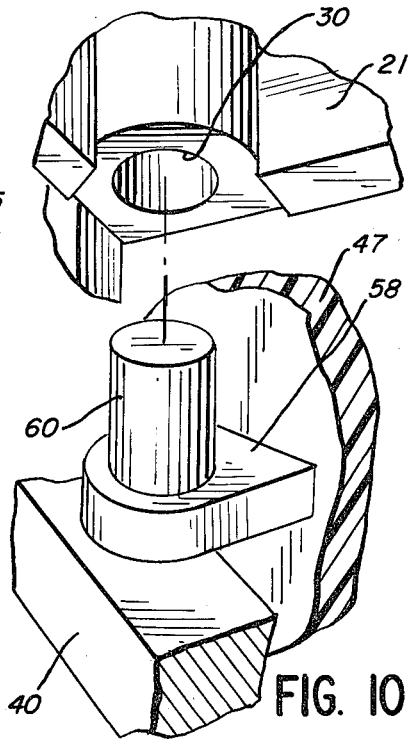
FIG. 10

FURNITURE GUARD AND BEARING PAD FOR VACUUM CLEANER NOZZLE

BACKGROUND OF THE INVENTION

1. Field of the Invention

This invention relates to vacuum cleaner structures and, in particular, to furniture guard bumpers for use on a vacuum cleaner nozzle.

2. Description of the Background Art

In U.S. Pat. No. 1,695,246, John R. Gammeter shows a vacuum cleaner structure wherein a bumper is secured to the nozzle by buttons provided on opposite ends thereof received in openings in the nozzle rear wall. Means are provided at the corners of the bumper defining diagonal webs seating in cooperating kerfs in the nozzle for preventing displacement thereof. The bumper is molded to a size and shape to fit tightly about the nozzle and is formed of resilient material, such as molded rubber, permitting the buttons to hold the bumper taut about the exposed faces of the nozzle.

Another form of furniture guard bumper is shown in U.S. Pat. No. 2,648,090 of Frank S. Howard. The bumper illustrated therein includes retaining end portions receivable in slots in the nozzle housing.

Carl E. Meyerhoefer shows, in U.S. Pat. No. 2,857,613, a furniture guard bumper for use with a vacuum cleaner having a flange portion which, when the bumper is mounted on the housing, is interposed between spaced walls of the housing to function on the order of a gasket, as well as a retaining member to minimize the transmission of noise and vibration between the parts.

In U.S. Pat. No. 3,916,476 of Milton J. Johnson et al, which patent is owned by the assignee hereof, the bumper strip is provided with an attaching portion received in a slot in the door defining the sidewall of the nozzle to secure the bumper strip to the door.

Dale E. Lowder et al, in U.S. Pat. No. 3,798,697, disclose a floor polisher wherein a bumper is mounted on the housing by means of a tongue on the housing engaging a groove in the bumper to trap the peripheral portion of the bumper between the motor housing portion and brush housing portion.

In U.S. Pat. No. 3,802,026, Bengt Olof Crener shows a vacuum cleaning apparatus wherein resilient springs are provided for biasing the bearing supports so as to urge the agitator or beater brush downwardly against the surface being cleaned.

SUMMARY OF THE INVENTION

The present invention comprehends an improved vacuum cleaner structure wherein a molded bumper defines a furniture guard and bearing pad structure.

The bumper, in the illustrated embodiment, is preformed to closely fit the irregular shape of the nozzle cover portion to which it is removably mounted by a plurality of connectors slidably received in downwardly opening slots in the peripheral wall portion of the cover portion of the nozzle.

The connector means includes a plurality of different configuration connectors at spaced positions along the length of the bumper.

In the illustrated embodiment, bearing pads are provided on the bumper, and more specifically, in the illustrated embodiment, are formed integrally therewith to extend between the bearing for the beater brush carried in opposite projecting sidewall portions of the nozzle base, and the cover portion of the nozzle.

The bearing pads may be provided, as shown in the illustrated embodiment, with locating projections received in recesses in the nozzle cover portion for accurately positioning and retaining the bearing pads in the assembly.

In the illustrated embodiment, the cover portion defines, in its sidewall portions, oppositely located openings which receive projecting portions of the base carrying the beater brush bearings.

In the illustrated embodiment, the projections of the base terminate outwardly flush with the sidewalls of the cover and the bumper extends about the cover portion so as to overlie the projecting portions of the base, thereby effectively minimizing the width of the nozzle relative to the length of the beater brush.

The bearing pads define further means for securing the bumper to the nozzle and, thus, cooperate with the T-connectors in effectively retaining the bumper in place on the nozzle during normal use.

The locating and retaining projections of the bumper pads are disposed adjacent the openings in the nozzle walls for improved securing of the bumper to the nozzle at this position.

In the illustrated embodiment, the bumper is first installed on the lower edge of the nozzle cover, and the nozzle cover is then installed on the base. Portions of the base then underlie lower edge portions of the bumper, preventing separation of the bumper from the nozzle cover prior to disassembly of the nozzle cover from the base.

The bumper of the present invention includes a horizontally extending lower front edge portion which is positioned overlying and closely adjacent to a horizontally extending front edge portion of the base, when the nozzle cover is installed on the base, thus ensuring that the bumper is properly located relative to the nozzle cover and base for efficient furniture guard performance.

The bumper of the present invention is extremely simple and economical of construction while yet providing for facilitated installation and removal when desired, and providing effectively positive means for retention thereof on the nozzle during normal use of the vacuum cleaner structure.

BRIEF DESCRIPTION OF THE DRAWING

Other features and advantages of the invention will be apparent from the following description taken in connection with the accompanying drawing wherein:

FIG. 1 is a perspective view of a vacuum cleaner nozzle having an improved bumper structure embodying the invention, a portion of the bumper being broken away to facilitate illustration of the invention;

FIG. 2 is a fragmentary bottom plan view of the nozzle cover portion with the midportion thereof broken away;

FIG. 3 is a fragmentary vertical section taken substantially along the line 3—3 of FIG. 1;

FIG. 4 is a fragmentary perspective view of a corner of the assembled base and cover portions of the nozzle with the bumper structure removed to facilitate illustration;

FIG. 5 is a plan view of the bumper with portions shown in section to facilitate illustration of the invention;

FIG. 6 is a transverse section taken substantially along the line 6—6 of FIG. 5;

FIG. 7 is a vertical section taken substantially along the line 7—7 of FIG. 5;

FIG. 8 is a fragmentary enlarged perspective view looking from the line 8—8 of FIG. 5;

FIG. 9 is a fragmentary enlarged perspective view looking from the line 9—9 of FIG. 5; and FIG. 10 is a fragmentary perspective view looking from the line 10—10 of FIG. 5 and with a portion of the cover of the nozzle illustrated in association therewith.

DESCRIPTION OF THE PREFERRED EMBODIMENT

In the exemplary embodiment of the invention as disclosed in the drawing, a vacuum cleaner nozzle generally designated 10 is shown to include a nozzle cover portion 11 and a nozzle base portion 12. The base portion is provided with suitable wheels 13 for rolling movement of the nozzle on a surface to be cleaned. A suction conduit connector 14 is swingably mounted to the nozzle for connection thereto of a suitable suction wand (not shown) of conventional construction. A power cord 15 may be provided for providing electrical power such as to an electrical drive motor (not shown), as conventionally provided for driving the beater brush 16 of the nozzle.

The present invention is concerned with the provision of a bumper generally designated 17 extending horizontally at least partially about the periphery 18 of the nozzle, and more specifically, about the adjoining peripheral wall 19 of the cover portion and peripheral wall 20 of the base.

Peripheral wall 18 of the nozzle defines a generally T-shaped horizontal configuration. Thus, as seen in FIG. 2, nozzle cover 11 is laterally enlarged at front portion 21. The cover portion wall 19, as shown in FIG. 2, defines opposite sidewall portions 22 and 23, a front wall portion 24, and inturned rear portions 25 and 26.

As further shown in FIG. 2, each of the sidewalls 22 and 23 defines a lower edge 27 and a pair of slots 28 and 29 opening downwardly through the lower edge. The front portion of the sidewall at 21 defines a pair of cylindrical recesses 30 and 31 on the right side of the nozzle cover 11 as shown in FIG. 2, and a like pair of recesses is provided on the left side of the nozzle cover.

Front wall 24 of the nozzle cover defines a lower edge 32 and four downwardly opening slots 33, 34, 35 and 36 opening through the lower edge 32.

Beater brush 16 is rotatably carried in the front portion of the nozzle on suitable bearings 37 received in a cup-shaped support 38 on the base portion 12 and a downwardly opening cup-shaped portion 39 on the cover portion 11. As shown in FIG. 4, the bearings include a forwardly projecting shoulder portion 40 which underlies the cylindrical recess 31 in the assembled arrangement of the nozzle.

Referring now to FIG. 5, the improved bumper element 17 is shown to comprise a one-piece, preformed element formed of suitable resilient material, such as synthetic resin, having a configuration corresponding to the outer configuration of the peripheral wall 18 of the nozzle. Thus, as shown in FIG. 5, the bumper includes a pair of sidewall portions 41 and 42, a front wall portion 43, and a pair of inturned rear wall portions 44 and 45. Each of the sidewalls defines a rear section 46 and a front section 47. As shown in FIGS. 5, 7 and 9, sidewall rear section 46 and rear wall 45 are provided with T-shaped connectors 49. The T-shaped connector on rear wall 45 is adapted to be slidably received in a slot 50 in cover 11. Connectors 49 on the rear section 46 of the sidewall are adapted to be received in slots 28 and 29 of the cover portion sidewall. As shown in FIG. 9, the T-connectors 49 are spaced slightly below the upper edge 51 of the bumper. Each of the connectors is defined by a stem portion 52 and a head portion 53 whereby the stem portion may be received in the corresponding slot in the cover portion peripheral wall, with the head portion being disposed inwardly thereof to retain the bumper against outward displacement from the wall.

Front wall 43 of the bumper is provided with four T-shaped connectors 54 adapted to be slidably received in slots 33, 34, 35 and 36 of the front wall 24 of the nozzle cover portion 11. As shown in FIGS. 6 and 8, the front wall connectors are generally similar to the connectors 49, being defined by stem portions 55 and head portions 56. The head portions 56 extend downwardly to substantially coextensively of the lower edge 57 of front wall 43. As shown in FIG. 3, the lower edge 57 is a horizontally extending lower front edge portion which is positioned overlying and closely adjacent to a horizontally extending front edge portion 70 of the base, when the nozzle cover and the bumper 17 carried thereon is installed on the base. This ensures that the bumper is properly located relative to the nozzle cover and base for efficient furniture guard performance and pleasing appearance of the vacuum cleaner structure.

Front section 47 of the sidewalls 41 and 42 is provided with a pair of bearing pads 58 and 59. As shown in FIG. 10, the bearing pads are provided with turned distal cylindrical pin portions 60 adapted to be received in the recesses 30 and 31 of the nozzle cover portion 11. Thus, the cooperating bearing pads and pin portions define resilient means for retaining the bearing means in the cup-shaped support portions 38 of the nozzle base portion and further serve to retain the bumper 17 in assembled relationship to the nozzle.

The bumper 17 may be readily installed on the nozzle cover 11 by sliding movement of the T-section connectors relative to the slots of the nozzle cover. In each instance, the head portion of the connector is disposed inwardly of the cover portion sidewall, front wall or rear wall, with the stem portion slid inwardly through the slot, thereby retaining the bumper against the outer surface of the cover portion peripheral wall. The pin portions 60 of the bearing pads are inserted in the corresponding recesses 30 and 31 of the nozzle cover to retain the bearing pads in position between the bearing portions 40 mounted in the base portion 12 and cover portion 11 of the nozzle in the assembled relationship.

As indicated above, the cup-shaped support 38 of the base is disposed flush with the portion 39 of the cover, as seen in FIG. 1, with the front section 47 of the bumper extending across the joint therebetween. This arrangement provides for minimum width of the nozzle for optimum edge cleaning.

Thus, the bumper of the present invention is extremely simple and economical of construction while yet providing for facilitated installation and removal, providing for resilient mounting of the beater brush bearings and providing for effectively improved edge cleaning operation of the vacuum cleaner apparatus.

The foregoing disclosure of specific embodiments is illustrative of the broad inventive concepts comprehended by the invention.

The embodiments of the invention in which an exclusive property or privilege is claimed are defined as follows:

1. In a vacuum cleaner nozzle having a base member, a cover defining a peripheral wall and being mounted to the base member, a pair of bearings, and a batter brush having a support rotatably journaled in said bearings, the improvement comprising:

a bumper mounted to said cover peripheral wall to define a peripheral furniture guard thereon; and resilient means carried by the bumper extending between said nozzle cover and bearings defining resilient bearing pad means.

2. The vacuum cleaner nozzle structure of claim 1 wherein said peripheral wall defines a plurality of recesses and said resilient means on the bumper comprises a plurality of resilient pad elements provided with locating projections received in said recesses for accurately positioning and retaining said pad elements between said peripheral wall and bearings.

3. The vacuum cleaner nozzle structure of claim 1 wherein said peripheral wall defines a plurality of cylindrical recesses and said resilient means on the bumper comprises a plurality of resilient pad elements provided with cylindrical locating projections received in said recesses for accurately positioning and retaining said pad elements between said peripheral wall and bearings.

4. The vacuum cleaner nozzle structure of claim 1 wherein said peripheral wall is generally T-shaped and said bumper is preformed to have a complementary configuration for facilitated conforming mounting to said wall.

5. The vacuum cleaner nozzle structure of claim 1 wherein said bumper is provided with a plurality of T-section connectors and said peripheral wall is provided with a corresponding plurality of slots opening through an edge thereof for slidably receiving said connectors to retain the bumper on said wall.

6. In a vacuum cleaner nozzle having a base member, a cover defining a peripheral wall and being mounted to the base member, a pair of bearings, and a beater brush having a support rotatably journaled in said bearings, the improvement comprising:

a bumper;

mounting means for mounting the bumper to said cover peripheral wall to define a peripheral furniture guard thereon, said mounting means comprising a plurality of T-section connectors carried by the bumper at positions spaced along the length thereof, each connector having a stem portion and a head portion, and means on said peripheral wall defining slots opening through said edge portion of a connector with the head portion thereof disposed inwardly of the wall to releasably retain the bumper outwardly on the wall; and resilient means carried by the bumper extending between said nozzle cover and bearings defining resilient bearing pad means.

7. The vacuum cleaner nozzle structure of claim 6 wherein said peripheral wall defines a front wall of the nozzle provided with a plurality of said edge slots, and said bumper defines a front portion overlying said front wall and provided with a plurality of said T-shaped connectors for releasable retention of said bumper front portion to said front wall in said edge slots thereof.

8. The vacuum cleaner nozzle structure of claim 6 wherein said peripheral wall of said nozzle cover defines a front wall of the nozzle provided with a plurality of said edge slots on a lower edge thereof, and said bumper defines a front portion overlying said front wall and an underlying portion of said base and provided with a plurality of said T-shaped connectors for releasable retention of said bumper front portion to said front wall in said edge slots thereof, the underlying portion of the base ensuring retention of said connectors when said nozzle cover is mounted on said nozzle base.

9. The vacuum cleaner nozzle structure of claim 6 wherein said peripheral wall defines opposite sidewalls of the nozzle each provided with a plurality of said edge slots, and said bumper defines opposite side portions overlying said sidewalls respectively and provided with a plurality of said T-shaped connectors for releasable retention of said bumper side portions to said sidewalls in said edge slots thereof.

10. The vacuum cleaner nozzle structure of claim 6 wherein said peripheral wall defines a front wall of the nozzle provided with a plurality of said edge slots, and said bumper defines a front portion overlying said front wall and provided with a plurality of said T-shaped connectors for releasable retention of said bumper front portion to said front wall in said edge slots thereof, and said peripheral wall defines opposite sidewalls of the nozzle each provided with a plurality of said edge slots, and said bumper defines opposite side portions overlying said sidewalls respectively and provided with a plurality of said T-shaped connectors for releasable retention of said bumper side portions to said sidewalls in said edge slots thereof, said connectors of the front wall having a configuration different from that of the connectors of the sidewalls.

11. The vacuum cleaner nozzle structure of claim 6 wherein said peripheral wall of said nozzle cover defines a front wall of the nozzle provided with a plurality of said edge slots on a lower edge thereof, and said bumper defines a front portion overlying said front wall and a horizontally extending front edge portion of the base and provided with a plurality of said T-shaped connectors for releasable retention of said bumper front portion to said front wall in said edge slots thereof, said bumper front portion defining a lower edge and said connectors of the bumper front portion having lower edges coextensive with said lower edge to position said bumper overlying and closely adjacent to said front edge portion of said base thereby ensuring efficient furniture guard performance for said bumper.

12. The vacuum cleaner nozzle structure of claim 6 wherein said peripheral wall defines a front wall of the nozzle provided with a plurality of said edge slots, and said bumper defines a front portion overlying said front wall and provided with a plurality of said T-shaped connectors for releasable retention of said bumper front portion to said front wall in said edge slots thereof, said bumper front portion defining a lower edge and said connectors of the bumper front portion having lower edges coextensive with said lower edge.

13. The vacuum cleaner nozzle structure of claim 6 wherein said peripheral wall defines opposite sidewalls of the nozzle each provided with a plurality of edge slots, and said bumper defines opposite side portions overlying said sidewalls respectively and provided with a plurality of said T-shaped connectors for releasable retention of said bumper side portions to said sidewalls in said edge slots thereof, said bumper side portions defining a lower edge and said connectors of the bumper side portions being spaced above said lower edge.

14. In a vacuum cleaner nozzle having a lower base portion and an upper cover portion, the improvement comprising:

means on said base portion defining sidewalls having projecting opposite portions, said cover portion having sidewalls extending outwardly of said base portion sidewalls other than at said projecting portions and being provided with openings receiving said projecting portions; and means for rotatably supporting a beater brush on said projecting portions.

15. The vacuum cleaner nozzle structure of claim 14 wherein said projecting portions terminate outwardly substantially flush with said cover portion sidewalls.

16. The vacuum cleaner nozzle structure of claim 14 wherein said projecting portions terminate outwardly substantially flush with said cover portion sidewalls, and a molded bumper portion is secured to each of said cover portion sidewalls to overlie said base portion projecting portions.

17. The vacuum cleaner nozzle structure of claim 14 wherein said projecting portions terminate outwardly substantially flush with said cover portion sidewalls, and a molded bumper portion is secured to each of said cover portion sidewalls to overlie said base portion projecting portions, said bumper portions extending the full horizontal extent of said cover portion sidewalls.

18. The vacuum cleaner nozzle structure of claim 14 wherein said projecting portions terminate outwardly substantially flush with said cover portion sidewalls, and a molded bumper portion is secured to each of said cover portion sidewalls at said openings thereof to overlie said base portion projecting portions.

* * * * *

UNITED STATES PATENT AND TRADEMARK OFFICE

CERTIFICATE OF CORRECTION

PATENT NO. : 4,397,058

DATED : August 9, 1983

INVENTOR(S) : DAVID G. KOLAND

It is certified that error appears in the above-identified patent and that said Letters Patent is hereby corrected as shown below:

Claim 1, line 3 (col. 5, line 6), before "brush" correct "batter" to read --beater--.

Signed and Sealed this

*Fifteenth* Day of *May 1984*

[SEAL]

*Attest:*

GERALD J. MOSSINGHOFF

*Attesting Officer*

*Commissioner of Patents and Trademarks*